US007628233B1

(12) United States Patent
Hall et al.

(10) Patent No.: US 7,628,233 B1
(45) Date of Patent: Dec. 8, 2009

(54) CARBIDE BOLSTER

(76) Inventors: David R. Hall, 2185 S. Larsen Pkwy., Provo, UT (US) 84606; Scott Dahlgren, 2185 S. Larsen Pkwy., Provo, UT (US) 84606; Casey Webb, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/178,408

(22) Filed: Jul. 23, 2008

(51) Int. Cl.
*E21B 10/36* (2006.01)
*E21C 25/10* (2006.01)

(52) U.S. Cl. ..... 175/426; 175/427; 175/432; 175/435; 299/111; 299/113

(58) Field of Classification Search ..... 175/426, 175/427, 432, 435; 299/111, 113
See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |
| 4,439,250 | A | 3/1984 | Acharya |
| 4,465,221 | A | 8/1984 | Acharya |
| 4,484,644 | A | 11/1984 | Cook |
| 4,489,986 | A | 12/1984 | Dziak |
| 4,678,237 | A | 7/1987 | Collin |
| 4,682,987 | A | 7/1987 | Brady |
| 4,688,856 | A | 8/1987 | Elfgen |
| 4,725,098 | A | 2/1988 | Beach |
| 4,729,603 | A | 3/1988 | Elfgen |
| 4,765,686 | A | 8/1988 | Adams |
| 4,765,687 | A | 8/1988 | Parrott |
| 4,776,862 | A | 10/1988 | Wiand |
| 4,880,154 | A | 11/1989 | Tank |
| 4,932,723 | A | 6/1990 | Mills |

(Continued)

FOREIGN PATENT DOCUMENTS

| | | |
|---|---|---|
| DE | 3500261 | 7/1985 |

(Continued)

*Primary Examiner*—David J Bagnell
*Assistant Examiner*—Yong-Suk Ro
(74) *Attorney, Agent, or Firm*—Tyson J. Wilde

(57) ABSTRACT

A degradation assembly has a carbide bolster brazed within a hole formed in a surface. The bolster has a substantially straight cylindrical portion mostly disposed below the surface and a top end and a bottom end. The top end narrows from the cylindrical portion with a substantially annular concave curve to a planar interface adapted for bonding to a carbide substrate and the bottom end narrows from the cylindrical portion to a stem which bottoms out on a geometry of the hole.

17 Claims, 8 Drawing Sheets

U.S. PATENT DOCUMENTS 4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Andersson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A * 4/2000 Andersson et al. ..... 148/318
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,667 B1 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki et al.
6,966,611 B1 11/2005 Sollami
6,994,404 B1 2/2006 Sollami
7,204,560 B2 4/2007 Mercier
7,475,744 B2 * 1/2009 Pope ..... 175/430
2002/0175555 A1 11/2002 Mercier
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

FOREIGN PATENT DOCUMENTS

DE 3818213 11/1989
DE 4039217 8/1992
DE 19821147 11/1999
DE 10163717 5/2003
EP 0295151 6/1988
EP 0412287 7/1990
GB 2004315 3/1979
GB 2037223 11/1979
JP 3123193 1/2001

* cited by examiner

CARBIDE BOLSTER

BACKGROUND OF THE INVENTION

In downhole drilling, such as oil and gas drilling, often sinter polycrystalline diamond is incorporated into the bits. The diamond is supported by a carbide substrate typically brazed within pockets formed in the bits.

U.S. Pat. No. 5,533,582 to Tibbitts, which is herein incorporated by reference for all that it contains, discloses a full cutting element including a substantially cylindrical backing and cutter mounted thereon is cut generally along the length thereof to produce a pair of semicylindrical partial cutting elements. In the case of an unused cutting element, each partial cutting element is mounted on a different semicylindrical tungsten carbide base to produce a substantially cylindrical unit which is mounted on a bit using a low temperature braze. In the case of a used full cutting element, the cutting element is cut to separate the worn portion from the remainder of the bit and only the unused portion is used to form a cylindrical unit with a corresponding semicylindrical tungsten carbide base. In another aspect, a partial cutting element is received in a pocket formed on a bit body. The pocket includes a pair of opposed side surfaces which substantially flushly abut the curved surfaces of the backing on the partial cutter.

U.S. Pat. No. 4,254,840 to Shay, Jr., which is herein incorporated by reference for all that it contains, discloses a protruding insert for use in an oil well drill bit is disclosed which insert is made of a hard metal substance and utilizes a tangential spherical surface having opposed flattened sides.

U.S. Pat. No. 4,597,456 to Ecer, which is herein incorporated by reference for all that it contains, discloses a roller bit cutter comprising a tough, metallic generally conical and fracture resistant core having a hollow interior, the core defining an axis, an annular metallic radial bearing layer carried by said core at the interior thereof to support the core for rotation, said bearing layer extending about said axis, an impact and wear resistant metallic inner layer on the core, at the interior thereof, to provide an axial thrust bearing, and hard metallic inserts having anchor portions carried by the core and partly embedded therein, the inserts protruding outwardly at the exterior of the core to define cutters, at least some of the inserts spaced about said axis, and a wear resistant outer metallic layer on the exterior of said core.

U.S. Pat. No. 5,348,109 to Griffin, which is herein incorporated by reference for all that it contains, discloses a cutter assembly for a rotary drill bit comprising a preform cutting element mounted on a carrier. The cutting element includes a thin cutting table of polycrystalline diamond, defining a front cutting face and a cutting edge bonded to a less hard substrate which is in turn bonded to the carrier. The substrate which is in turn bonded to the carrier. The substrate and/or the carrier comprises a first portion of high erosion resistance, formed for example from tungsten carbide, and a second portion of lower erosion resistance, formed for example from tungsten metal, which is located in the vicinity of the cutting edge of the cutting element so that, in use, the wear flat is mostly formed in the material of lower erosion resistance.

BRIEF SUMMARY OF THE INVENTION

In one aspect of the invention a degradation assembly has a carbide bolster brazed within a hole formed in a surface. The bolster has a substantially straight cylindrical portion mostly disposed below the surface and a top end and a bottom end. The top end narrows from the cylindrical portion with a substantially annular concave curve to a planar interface adapted for bonding to a carbide substrate and the bottom end narrows from the cylindrical portion to a stem which bottoms out on a geometry of the hole.

The stem may comprise a substantially cylindrical side wall or it may comprise a taper less than five degrees. In some embodiments, the cylindrical portion is longer than the stem. In some cases, the cylindrical portion may be at least 150 percent longer than the stem. The bottom end may narrow from the cylindrical portion via a 40 to 60 degree angle. The bottom end may comprise a flat that bottoms out on the geometry of the hole.

The annular concave curve may be a radius curve, parabolic curve, elliptical curve, hyperbolic curve or combinations thereof. The cylindrical portion may be longer than the annular concave curve. In some embodiments, the cylindrical portion may be at least 150 percent as long as the annular concave curve. The planar interface may comprise a diameter greater than the stem.

The carbide substrate may comprise diamond bonded to it opposite the planar interface. The substrate may be less than 10 mm thick axially. The diamond may comprise a volume greater than the carbide substrate. The diamond may comprise a substantially conical geometry.

In some embodiments the surface may be incorporated into a fixed cutter bit, a percussion bit, a roof bolt bit, a roller cone bit or combinations thereof. In some embodiments a fixed cutter bit incorporated a plurality of blades and the bolster is disposed within a surface of the blades. The bolsters may be positioned on the blades of the fixed cutter bit at a positive angle. The bolster may be incorporated into a pick designed for pavement milling, mining, trenching, excavation, resurfacing, paint removal, or combinations thereof.

DETAILED DESCRIPTION OF THE INVENTION AND THE PREFERRED EMBODIMENT

Figure 1:
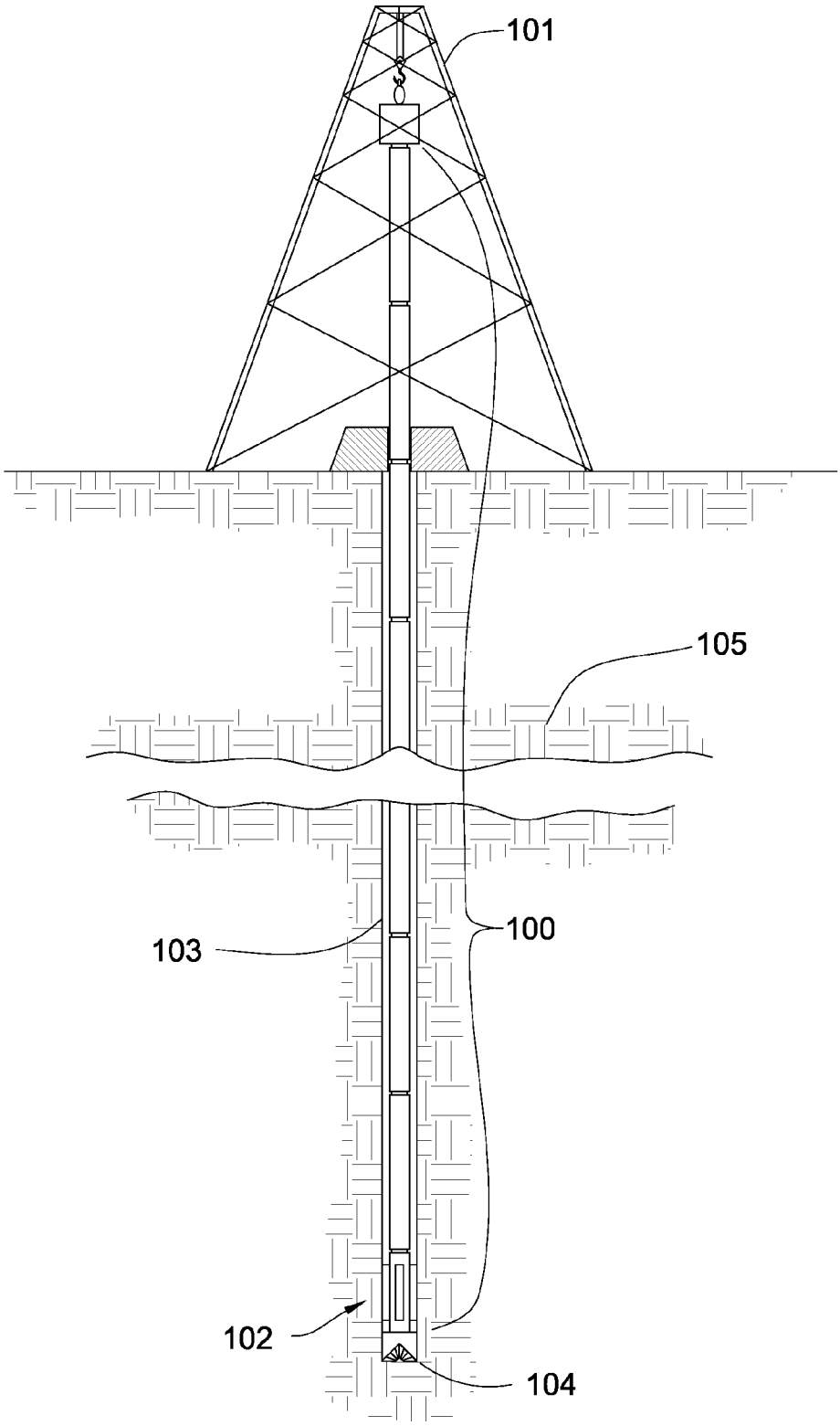
FIG. 1 is a perspective diagram of an embodiment of a drill string suspended in a bore hole.

Referring now to the figures, FIG. 1 is a cross-sectional diagram of an embodiment of a drill string 100 suspended by a derrick 101. A bottom-hole assembly 102 is located at the bottom of a bore hole 103 and comprises a drill bit 104 and a stabilizer assembly. As the drill bit 104 rotates down hole the drill string 100 advances farther into the earth. The drill string 100 may penetrate soft or hard subterranean formations 105.

Figure 2:
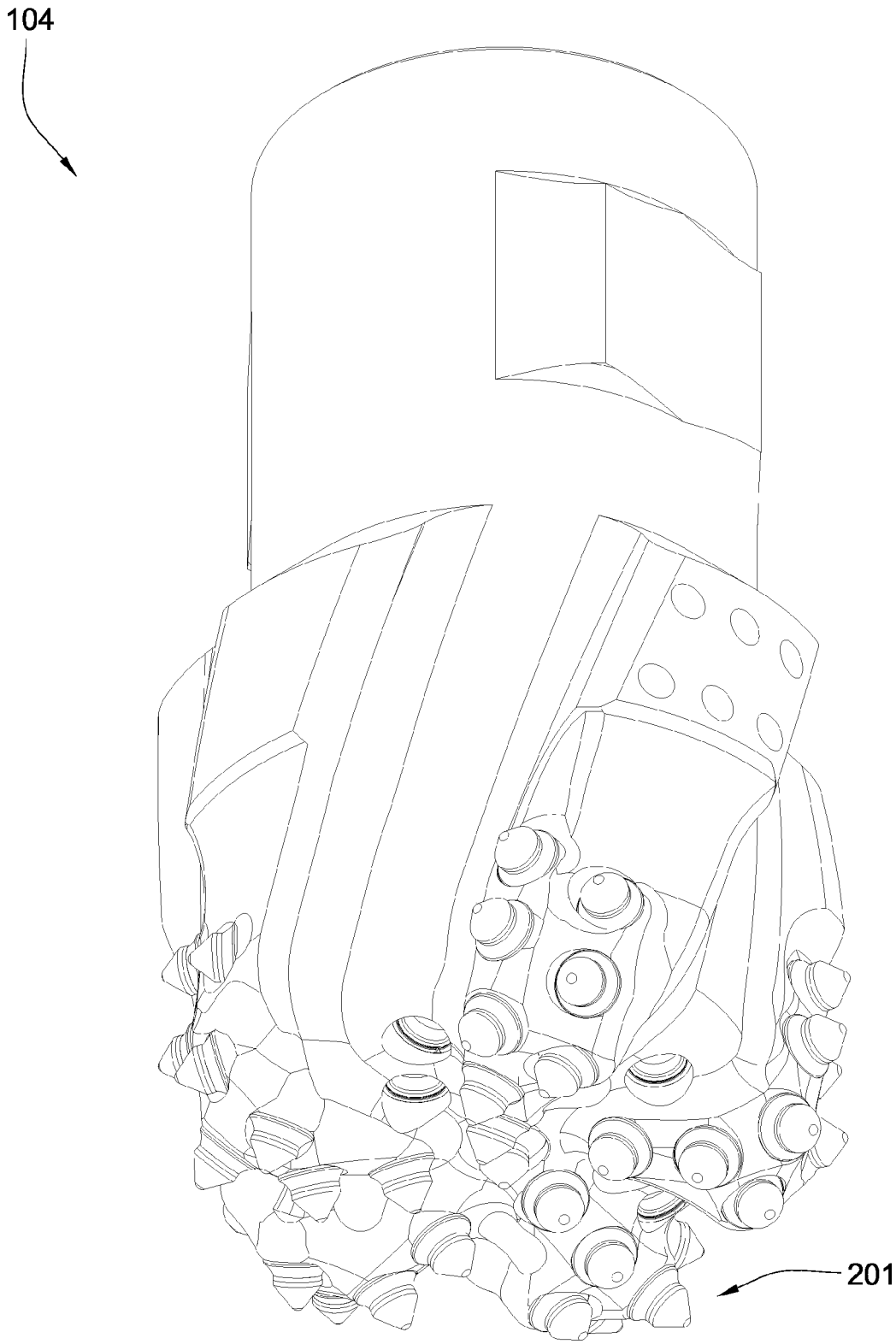
FIG. 2 is a perspective diagram of an embodiment of a degradation assembly incorporated into a fixed cutter drill bit.
Figure 3:
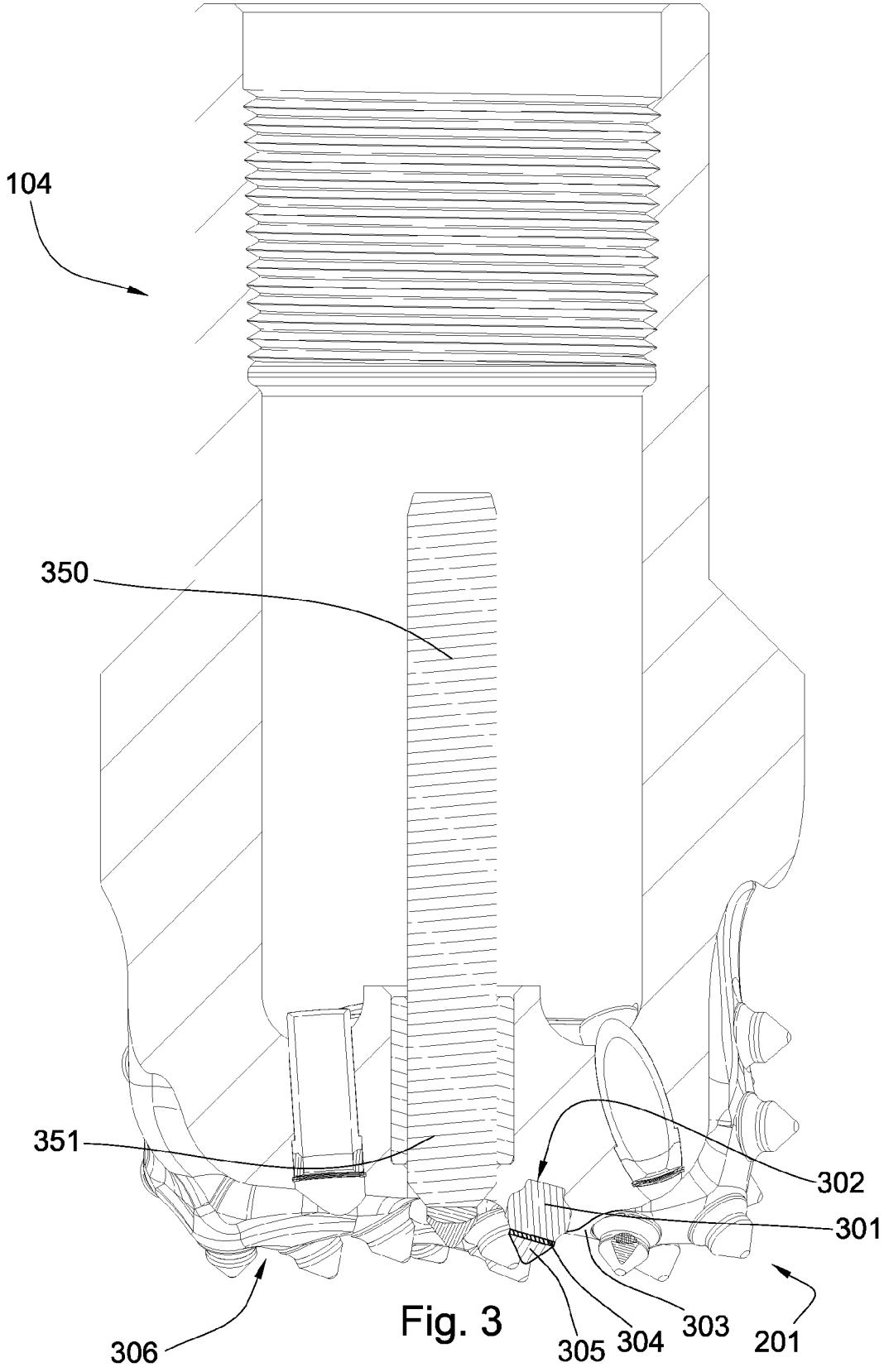
FIG. 3 is a cross-sectional diagram of another embodiment of a degradation assembly incorporated into a fixed cutter drill bit.

FIGS. 2 through 3 disclose an embodiment of at least one degradation assembly 201 incorporated into the drill bit 104. The drill bit 104 may be a fixed cutter drill bit 104 such as in the embodiment disclosed in FIGS. 2 through 3. The degradation assembly 201 comprises a carbide bolster 301 brazed within a hole 302 formed in a surface 303. The surface 303 may be incorporated into the working surface 306 of the fixed cutter drill bit 104. The bolster may also be incorporated into a distal end 351 of a jack element 350 adapted to extend beyond the working face of the drill. The diamond may comprise a substantially conical geometry. In some embodiments the hole is located in a surface of the blade formed in the working face and/or gauge of the drill bit. In other embodiments, the diamond may comprise a cylindrical table with a edge adapted for shearing the formation.

Figure 4A:
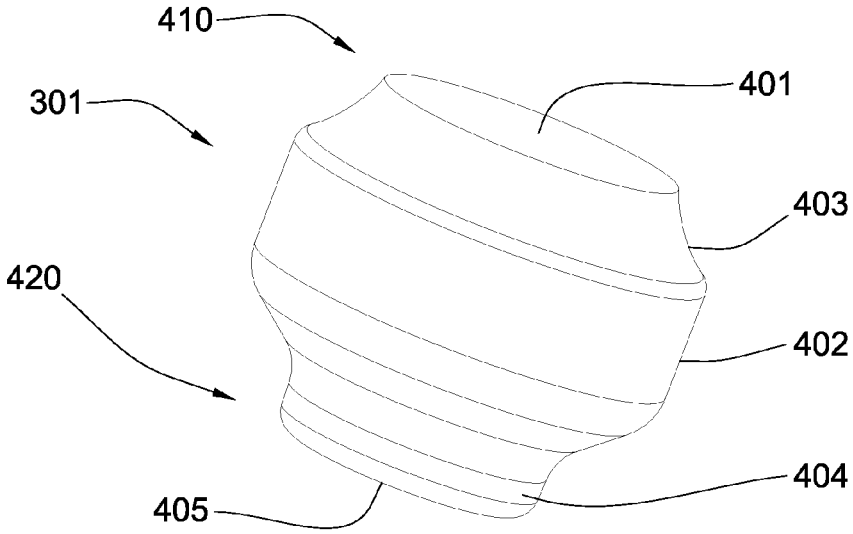
FIG. 4*a* is a perspective diagram of an embodiment of a carbide bolster.
Figure 4B:
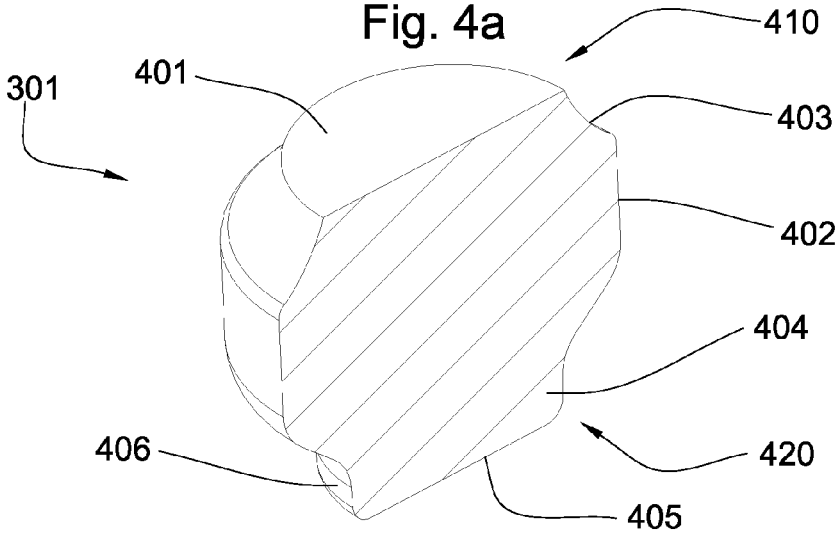
FIG. 4*b* is a cross-sectional diagram of another embodiment of a carbide bolster.
Figure 4C:
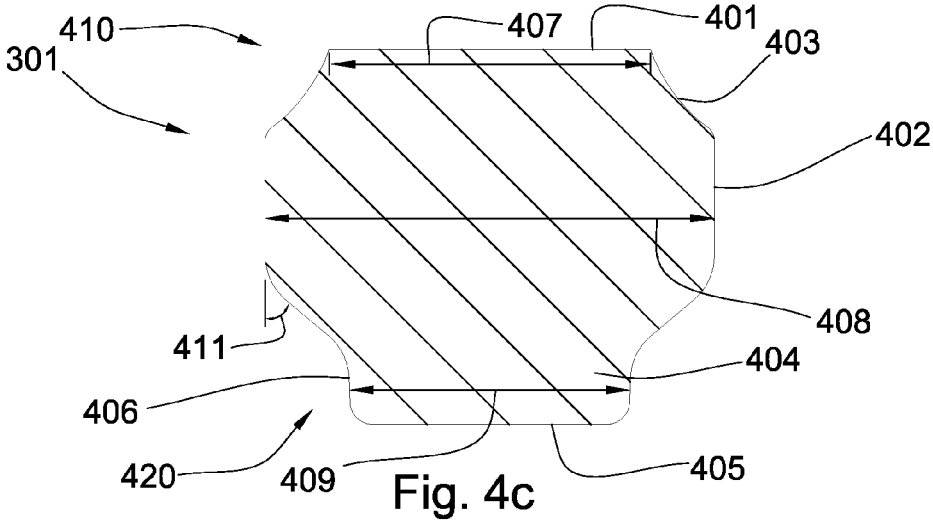
FIG. 4*c* is a cross-sectional diagram of another embodiment of a carbide bolster.

Referring now to FIGS. 4*a* through 4*c*, the bolster 301 comprises a top end 410 and a bottom end 420. The bolster 301 comprises a substantially straight cylindrical portion 402 at least mostly disposed below the surface 303. The substantially straight cylindrical portion 402 may be disposed completely below the surface 303. It is believed that by having the substantially straight cylindrical portion 402 disposed at least mostly below the surface 303 that rocking of the bolster 301 in the hole 302 may be reduced. For the purposes of this disclosure, rocking may be defined as to move back and forth or from side to side. It is believed that rocking may be induced by the harsh environment downhole and the large stresses placed on the drill bit 104 and the drill string 101. The top end 410 of bolster 301 narrows from the cylindrical portion 402 with a substantially annular concave curve 403 to a planar interface 401 adapted for bonding to a carbide substrate 304. The bottom end 420 may comprise a flat 405 that bottoms out on the geometry of the hole 302. It is believed that the stem 404 may assist the cylindrical portion 402 in reducing rocking that may occur to the bolster 301 while the bolster 301 is disposed in the hole 302.

The bottom end 420 of the bolster 301 narrows from the cylindrical portion 402 to a stem 404 which may bottom out on a geometry of the hole 302 formed in the surface 303. For the purposes of this disclosure bottoming out may be defined as to abut or engage. In some embodiments, a protrusion formed in the flat or in the hole may engage the other and may create a gap between the hole and the bolster to control the braze thickness. In other embodiments, an angle 411 of the bottom end may provide the gap.

The hole 302 may encompass the entire diameter 408 of the cylindrical portion 402. The cylindrical portion 402 may be longer than the stem 404. The cylindrical portion 402 may be at least 150 percent as long as the stem 404. The cylindrical portion 402 may be longer than the annular concave curve 403. The cylindrical portion 402 may be at least 150 percent as long as the annular concave curve 403. It is believed that by having the cylindrical portion 402 longer than the stem 404 and the annular concave curve 403 that rocking of the bolster 301 while in the hole 302 may be reduced or at least minimized. The cylindrical portion may take up at least half of the axial length of the bolster. The stem 404 may comprise a substantially cylindrical side wall 406. The bottom end 420 may narrow from the cylindrical portion 402 via a 40 to 60 degree angle 411. It is believed that the forming of stress concentrations in the degradation assembly 201 may be avoid by narrowing the bottom end 420 from the cylindrical portion 402 to the stem 404 via a 40 to 60 degree angle 411. The stem 404 may comprise a taper of less than 5 degrees, preferable 2 degrees. The annular concave curve 403 may be a radius. The annular 403 concave curve may be a parabolic, an elliptical, or a hyperbolic curve. It is believed that the annular curve 403 may assist in distributing loads placed on the degradation assembly 201 and reduce stress concentrations from forming in the degradation assembly 201.

The planar interface 401 may comprise a diameter 407 greater than a diameter 409 of the stem 404. The carbide substrate 304 may comprise diamond 305 bonded to it opposite the planar interface 401. The substrate 304 may be less than 10 mm thick. The diamond 305 may comprise a greater volume than the carbide substrate 304. The diamond 304 may comprise a substantially conical geometry. An example of a diamond insert that may be compatible with the present invention is disclosed in U.S. patent application Ser. No. 11/673,634, which is herein incorporated by reference for all that it discloses.

Figure 5:
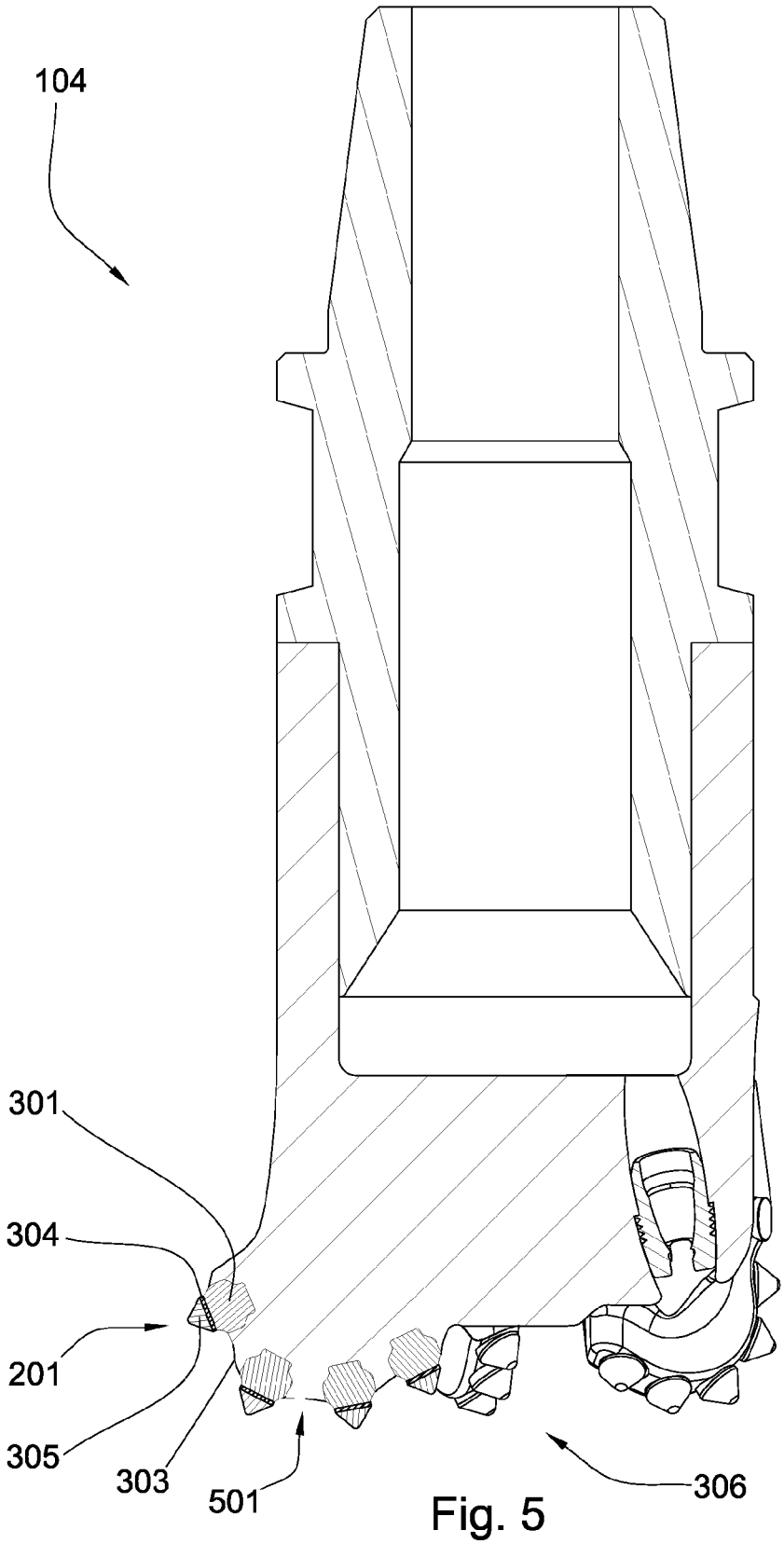
FIG. 5 is a cross-sectional diagram of another embodiment of a degradation assembly incorporated into a fixed cutter drill bit.
Figure 6:
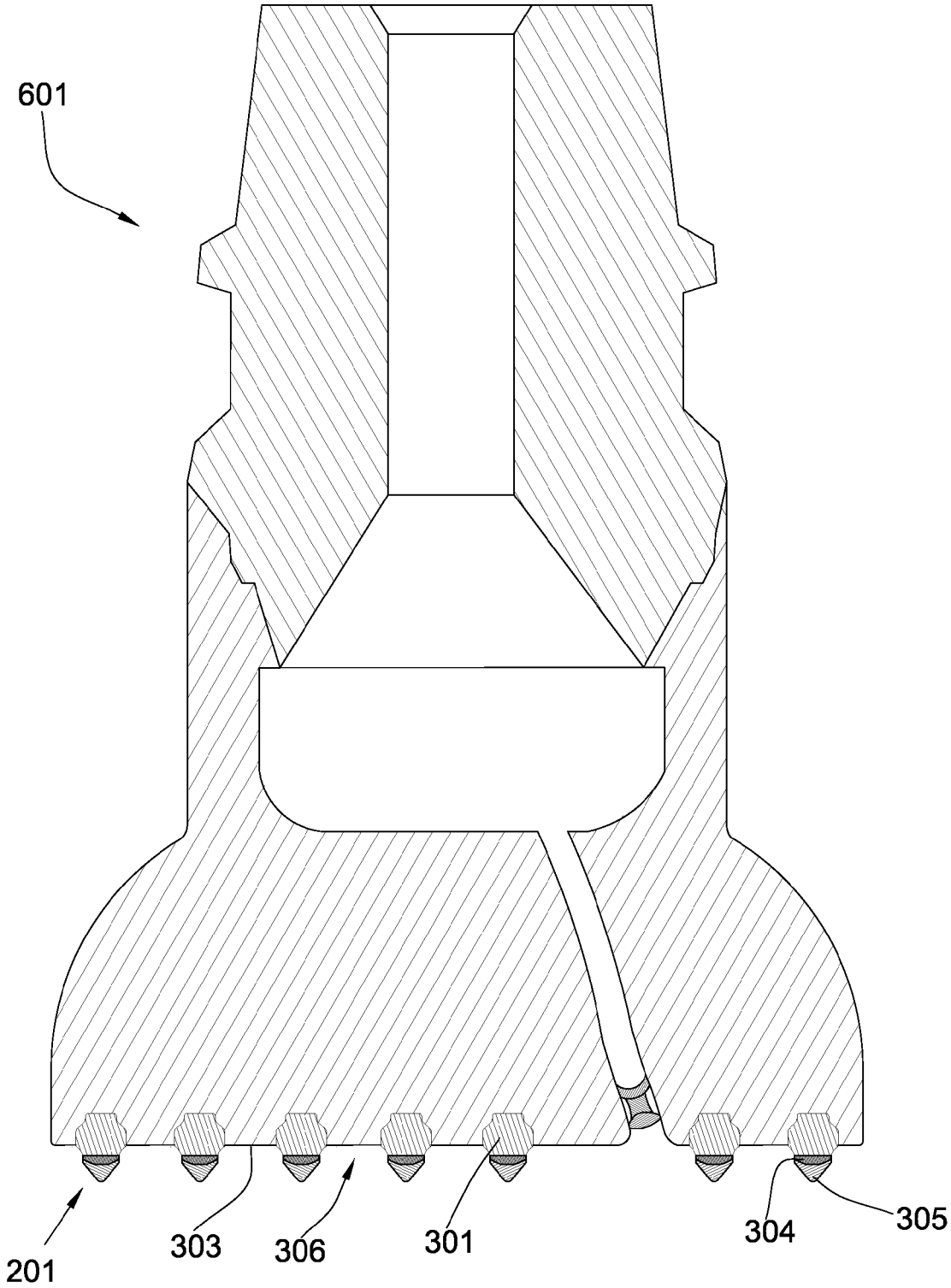
FIG. 6 is a cross-sectional diagram of an embodiment of a degradation assembly incorporated into a percussion drill bit.
Figure 7B:
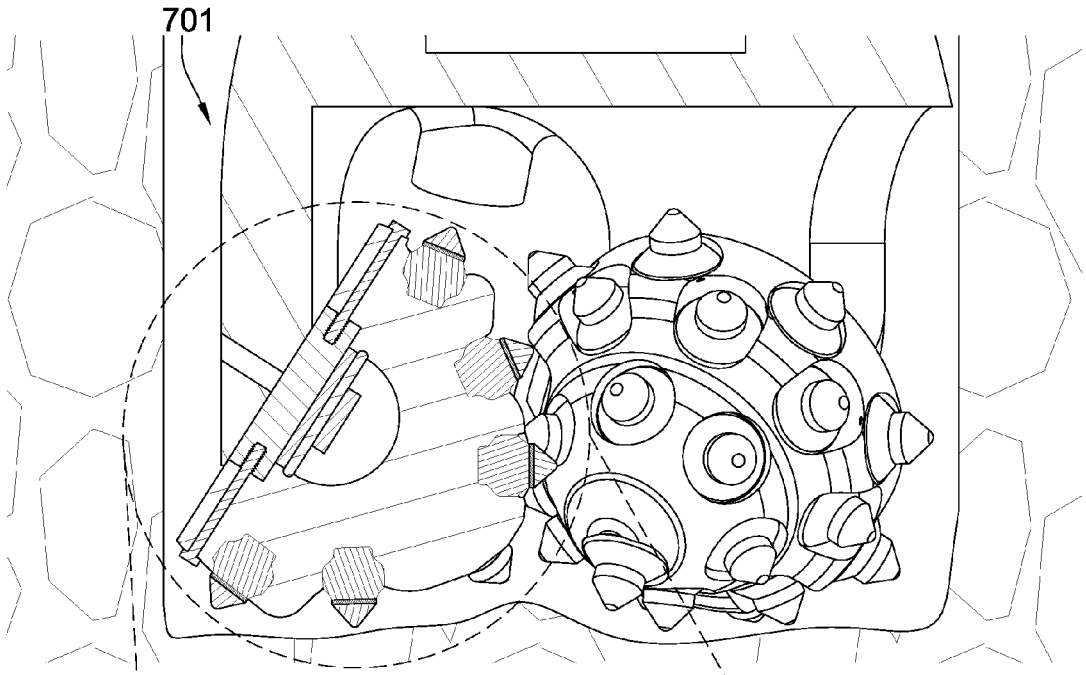
FIGS. 7*a* and 7*b* are cross-sectional diagrams of an embodiment of a degradation assembly incorporated into a roller cone bit.
Figure 7A:
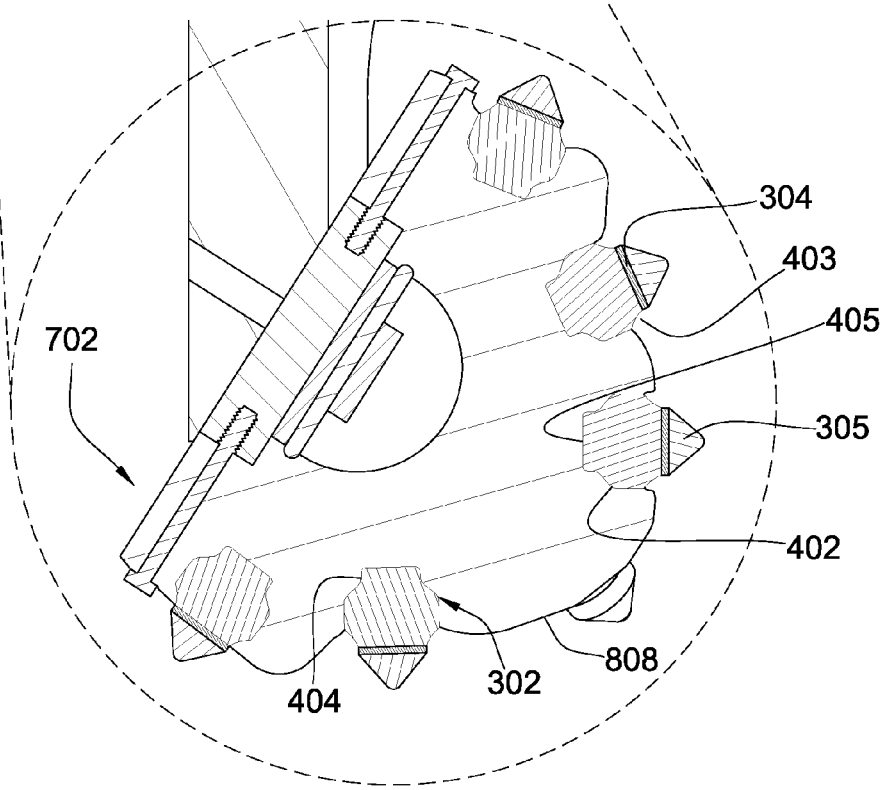

Referring now to FIGS. 5 through 7*b*, the bolster 301 may be positioned at a positive rake on the working surface 306. FIG. 5 discloses another embodiment of at least one degradation assembly 201 incorporated into a fixed cutter drill bit 104. In some embodiments the surface 303 may be on a blade 501 formed in the working surface 306 of the fixed cutter drill bit 104. FIG. 6 discloses an embodiment of at least one degradation assembly 201 incorporated into a percussion bit 601. In some embodiments the surface 303 may be incorporated on a cone 702 of a roller cone bit 702 such as in the embodiment of FIGS. 7*a-b*.

Figure 8:
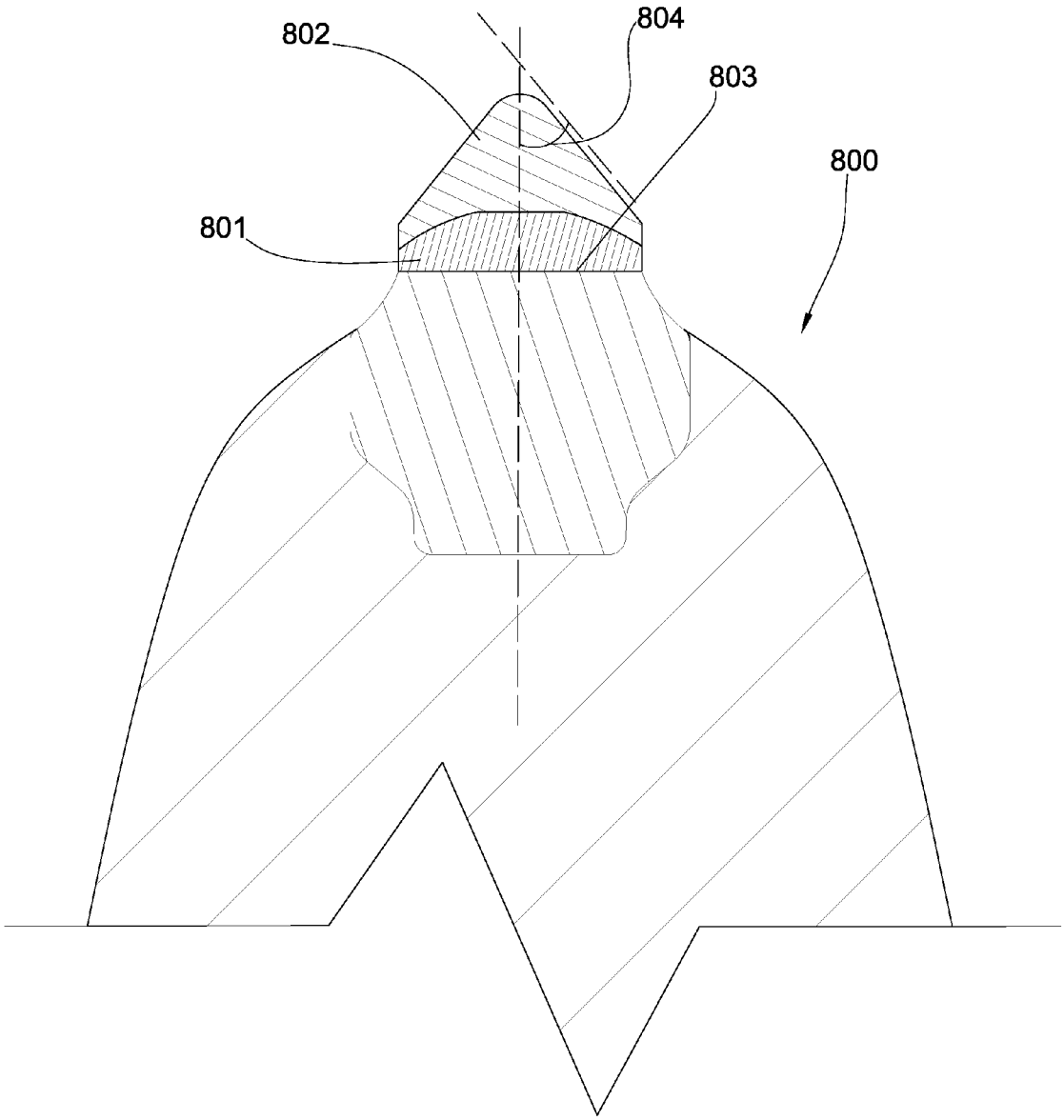
FIG. 8 is a cross-sectional diagram of an embodiment of a degradation assembly incorporated into a pick.

FIG. 8 discloses a bolster disposed within a front end of a pick 800. The pick 800 may be adapted for pavement milling, mining, trenching, excavating, or combinations thereof. In such embodiments, the cylindrical portion may take up at least half of the length of the bolster to reduce rocking. The stem may take up the remaining rocking moment that overcomes cylindrical portion. A carbide substrate 801 may be bonded to the planar interface 803 of the bolster. Sintered polycrystalline diamond 802 may be bonded to the substrate. The diamond may comprise a substantially conical geometry. The diamond may also comprise a greater volume than the substrate. The diamond may have an included angle 804 of 40 to 50 degrees. The diamond may be at least 0.150 thick.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a carbide bolster brazed within a hole formed in a surface;

the bolster comprises a substantially straight cylindrical portion at least mostly disposed below the surface and a top end and a bottom end;

the top end narrowing from the cylindrical portion with a substantially annular concave curve to a planar interface is bonded to a carbide substrate;

the carbide substrate is also bonded to diamond on an end opposite the planar interface, the diamond comprising a conical geometry;

the cylindrical portion being longer than the annular concave curve; and the bottom end narrowing from the cylindrical portion to a stem.

2. The assembly of claim 1, wherein the stem comprises a cylindrical side wall.

3. The assembly of claim 1, wherein the stem comprises a taper less than 5 degrees.

4. The assembly of claim 1, wherein the hole encompasses the entire diameter of the cylindrical portion.

5. The assembly of claim 1, wherein the surface is incorporated into a working surface of a fixed cutter drill bit.

6. The assembly of claim 5, wherein the surface is on a blade formed in the working surface.

7. The assembly of claim 5, wherein the bolster is positioned at a positive rake on the working surface.

8. The assembly of claim 7, wherein the cylindrical portion is at least 150 percent as long as the stem.

9. The assembly of claim 1, wherein the surface is incorporated on a cone of a roller cone bit.

10. The assembly of claim 1, wherein the cylindrical portion is longer than the stem.

11. The assembly of claim 1, wherein the bottom end narrows from the cylindrical portion via a 40 to 60 degree angle.

12. The assembly of claim 1, wherein the annular concave curve is a radius.

13. The assembly of claim 1, wherein the annular concave curve is a parabolic, an elliptical or a hyperbolic curve.

14. The assembly of claim 1, wherein the substrate is less than 10 mm thick.

15. The assembly of claim 1, wherein the diamond comprises a greater volume than the carbide substrate.

16. The assembly of claim 1, wherein the bottom end comprises a flat that bottoms out on a geometry of the hole.

17. The assembly of claim 1, wherein the planar interface comprises a diameter greater than the stem.

* * * * *